US008596228B2

(12) United States Patent
Kinomura

(10) Patent No.: US 8,596,228 B2
(45) Date of Patent: Dec. 3, 2013

(54) THERMOSTAT AND COOLING DEVICE FOR VEHICLE

(75) Inventor: Shigeki Kinomura, Shizuoka-ken (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 96 days.

(21) Appl. No.: 13/255,797

(22) PCT Filed: Oct. 7, 2010

(86) PCT No.: PCT/JP2010/067625

§ 371 (c)(1),
(2), (4) Date: Sep. 9, 2011

(87) PCT Pub. No.: WO2011/046058

PCT Pub. Date: Apr. 21, 2011

(65) Prior Publication Data

US 2012/0199084 A1 Aug. 9, 2012

(30) Foreign Application Priority Data

Oct. 15, 2009 (JP) ..... 2009-237968

(51) Int. Cl.
*F01P 7/14* (2006.01)

(52) U.S. Cl.
USPC ..... 123/41.1; 123/41.44; 236/101 C

(58) Field of Classification Search
USPC ..... 123/41.08–41.1, 41.44–41.47
See application file for complete search history.

(56) References Cited

U.S. PATENT DOCUMENTS

| | | | |
|---|---|---|---|
| 5,494,005 | A | 2/1996 | Saur |
| 5,711,258 | A | 1/1998 | Saur |
| 6,128,948 | A | 10/2000 | Shi et al. |
| 6,712,028 | B1 | 3/2004 | Robbins et al. |
| 2004/0163612 | A1 | 8/2004 | Takahashi |

FOREIGN PATENT DOCUMENTS

| | | | |
|---|---|---|---|
| DE | 43 30 215 | A1 | 3/1995 |
| DE | 196 06 202 | A1 | 8/1997 |
| DE | 10 2004 009 514 | A1 | 11/2004 |
| JP | A-2000-303841 | | 10/2000 |
| JP | A-2003-328753 | | 11/2003 |
| JP | A-2006-070782 | | 3/2006 |
| JP | A-2009-074380 | | 4/2009 |
| JP | A-2009-144624 | | 7/2009 |

OTHER PUBLICATIONS

May 23, 2011 International Preliminary Report on Patentability issued in International Patent Application No. PCT/JP2010/067625 (with translation).

International Search Report issued in Application No. PCT/JP2010/067625; Dated Nov. 2, 2010 (With Translation).

German Office Action issued in Application No. 11 2010 001 317.9; Dated Mar. 1, 2013 (With Translation).

*Primary Examiner* — Noah Kamen

(74) *Attorney, Agent, or Firm* — Oliff & Berridge, PLC

(57) ABSTRACT

If an engine undergoes high-load operations immediately after start up from its cold state, a thermostat is closed to inhibit passage of cooling water through the inside of the engine, and the cooling water stagnant in a cylinder head receives heat from a combustion chamber. Therefore, the cooling water will possibly boil. However, the thermostat is formed in such a manner that a valve body may be opened forcedly if the discharge flow rate of a water pump is greater than the flow rate in a normal use region. Therefore, in such a situation, the discharge flow rate of the water pump is increased greater than the flow rate in the normal use region to open the valve body with good response, thereby passing water into the engine quickly. This configuration prevents the cooling water stagnant in the cylinder head from boiling before the valve body is opened completely.

5 Claims, 5 Drawing Sheets

Fig.2(a)
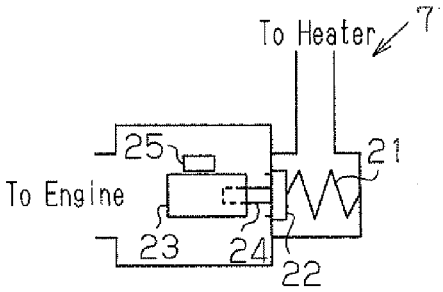
Fig.2(b)
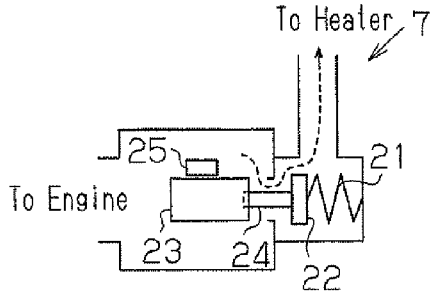
Fig.2(c)
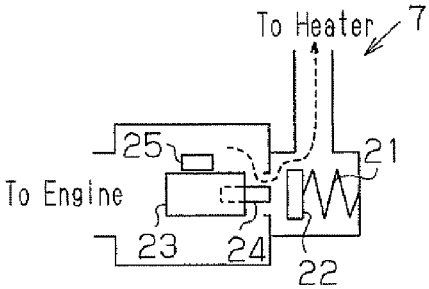
Fig.3
| State of Engine | Water inside Engine | Thermostat | Temperature-Sensitive Valve |
|---|---|---|---|
| Cold | Stopped | Closed | Closed |
| Half-Warmed-Up | Circulated | Open | Closed |
| After Warming Up | Circulated | Open | Opened |

THERMOSTAT AND COOLING DEVICE FOR VEHICLE

FIELD OF THE INVENTION

The present invention relates to a thermostat and a cooling device for a vehicle.

BACKGROUND OF THE INVENTION

A cooling device for a vehicle is known that is provided with a cooling water circuit for circulating cooling water through the inside of an engine by driving a pump and a thermostat in a part of the cooling water circuit that is downstream of the engine. The thermostat permits and inhibits passage of the cooling water through the inside of the engine by selectively opening and closing a valve body in accordance with the temperature of the cooling water.

A thermostat having such a configuration inhibits the passage of the cooling water by closing the valve body if the temperature of the cooling water is low. On the other hand, if the temperature of the cooling water is high, the thermostat opens the valve body by using a thermoelement that receives heat from the cooling water, thereby permitting the passage of the cooling water inside of the engine. By selectively opening and closing the valve body of the thermostat in such a manner, the passage of the cooling water through the inside of the engine is inhibited if the engine is cold owing to the low cooling water temperature, thereby promoting warming up of the engine. On the other hand, if the temperature of the cooling water is high, the passage of the cooling water through the inside of the engine is permitted, to prevent the cooling water inside the engine from boiling.

It is to be noted that immediately after the engine starts from the cold state, the cooling water in the cooling water circuit is low in temperature, so that the thermostat is closed to promote warming up of the engine. In such a case, the thermostat is closed to inhibit the passage of the cooling water through the inside of the engine. In this state, if heat is generated a lot in a combustion chamber owing to a high-load operation of the engine, such a situation occurs in which the temperature of the cooling water only in the cylinder head of the engine rises while the temperature of the cooling water around the thermostat element does not rise. In such a situation, the cooling water stagnant in the cylinder head of the engine receives heat from the combustion chamber so that its temperature may rise excessively, and can start boiling.

To cope with such a situation, a device described in Patent Document 1 is provided with a heat generator in a thermostat for heating a thermoelement. By permitting the heat generator to heat the thermoelement, a valve body can be opened even if cooling water around the thermoelement is low in temperature. In this case, if the cooling water in the cylinder head of the engine in a condition where the thermostat valve body is closed reaches a temperature at which the water will possibly boil, the thermoelement is heated by the heat generator of the thermostat, thereby opening the valve body. By permitting the passage of the cooling water to the inside of the engine by opening the valve body in such a manner, it is possible to prevent the water stagnant in the cylinder head from boiling.

PRIOR ART DOCUMENT

Patent Document

Patent Document 1: Japanese Laid-Open Patent Publication No. 2003-328753

SUMMARY OF THE INVENTION

However, in a case where the temperature of the cooling water is low around the thermoelement, even if the thermoelement is heated by the heat generator, it takes a long time such as 20 to 30 seconds until the valve body is opened completely. Accordingly, even if the thermostat is heated by the heat generator, the cooling water stagnant in the cylinder head will possibly boil before the cooling water is permitted to pass through the inside of the engine after the valve body is actually opened.

It is an objective of the present invention to provide a thermostat and a cooling device for a vehicle that can prevent cooling water stagnant in a cylinder head of an engine from boiling after the engine is started up from its cold state.

Means for achieving the above objectives and advantages thereof will now be discussed.

To achieve the foregoing objective and in accordance with a first aspect of the present invention, a thermostat is provided that is located on the downstream side of an engine in a cooling water circuit in which cooling water is circulated through the inside of the engine by driving a pump. The thermostat includes a valve body for inhibiting or permitting passage of the cooling water flowing through the thermostat and a thermoelement for driving the valve body based on a temperature of the cooling water. If the temperature of the cooling water is lower than a determination value, the thermostat closes valve body to inhibit passage of the cooling water through the inside of the engine. If the temperature of the cooling water is higher than or equal to the determination value, the thermoelement, which receives heat transferred from the cooling water, opens the valve body to permit passage of the cooling water through the inside of the engine. The thermostat includes a heat generator for heating the thermoelement in order to open the valve body forcedly if the temperature of the cooling water in the cooling water circuit is lower than the determination value. The valve body can be opened by an external device independently of operation of the thermostat based on the temperature of the cooling water in the cooling water circuit.

In accordance with a second aspect of the present invention, a thermostat is provided that is located on the downstream side of an engine in a cooling water circuit in which cooling water is circulated through the inside of the engine by driving a pump. The thermostat includes a valve body for inhibiting or permitting passage of the cooling water flowing through the thermostat and a thermoelement for driving the valve body based on a temperature of the cooling water. If the temperature of the cooling water is lower than a determination value, the thermoelement closes the valve body to inhibit passage of the cooling water through the inside of the engine. If the temperature of the cooling water is higher than or equal to the determination value, the thermoelement, which receives heat transferred from the cooling water, opens the valve body to permit passage of the cooling water through the inside of the engine. The thermostat includes a heat generator for heating the thermoelement in order to open the valve body forcedly if the temperature of the cooling water in the cooling water circuit is lower than the determination value. The valve body receives pressure from the cooling water circulated through the cooling water circuit by driving the pump and is opened on the basis of the pressure of the cooling water if the discharge flow rate of the cooling water from the pump is greater than a maximum value in a normal use region.

In accordance with a third aspect of the present invention, a cooling device for a vehicle is provided. The cooling device for a vehicle includes a cooling water circuit through which cooling water is circulated through the inside of an engine by driving a pump, a water temperature sensor for detecting a temperature of the cooling water at an outlet of the engine along the cooling water circuit, the thermostat according to the first or second aspect, and a control unit for controlling driving of the pump and the thermostat. The thermostat is adapted to close the valve body when the temperature of the cooling water around the thermoelement is less than the determination value. The control unit is adapted to open the valve body in a closed state by heating the thermoelement with the heat generator of the thermostat when the temperature of the cooling water detected by the water temperature sensor reaches at least the determination value. In a case where the temperature of the cooling water detected by the water temperature sensor after start-up of the engine from its cold state is less than the determination value, if the temperature of the cooling water in the cylinder head of the engine estimated on the basis of operation conditions of the engine is higher than or equal to such a value that the cooling water will possibly boil, the control unit sets the discharge flow rate of the pump to a value greater than the maximum value in the normal use region.

BRIEF DESCRIPTION OF THE DRAWINGS

FIGS. 2(*a*) to 2(*c*) are outlined views showing the configuration of the thermostat of the cooling device in FIG. 1;

FIG. 3 is a table showing a state of engine cooling water circulation and operating states of a valve and the thermostat corresponding to a warm-up state of an engine in the cooling device for a vehicle in the present embodiment;

DETAILED DESCRIPTION OF THE PREFERRED EMBODIMENTS

The following will describe a cooling device for a vehicle and a thermostat provided in it according to one embodiment of the present invention with reference to FIGS. 1 to 8.

Figure 1:
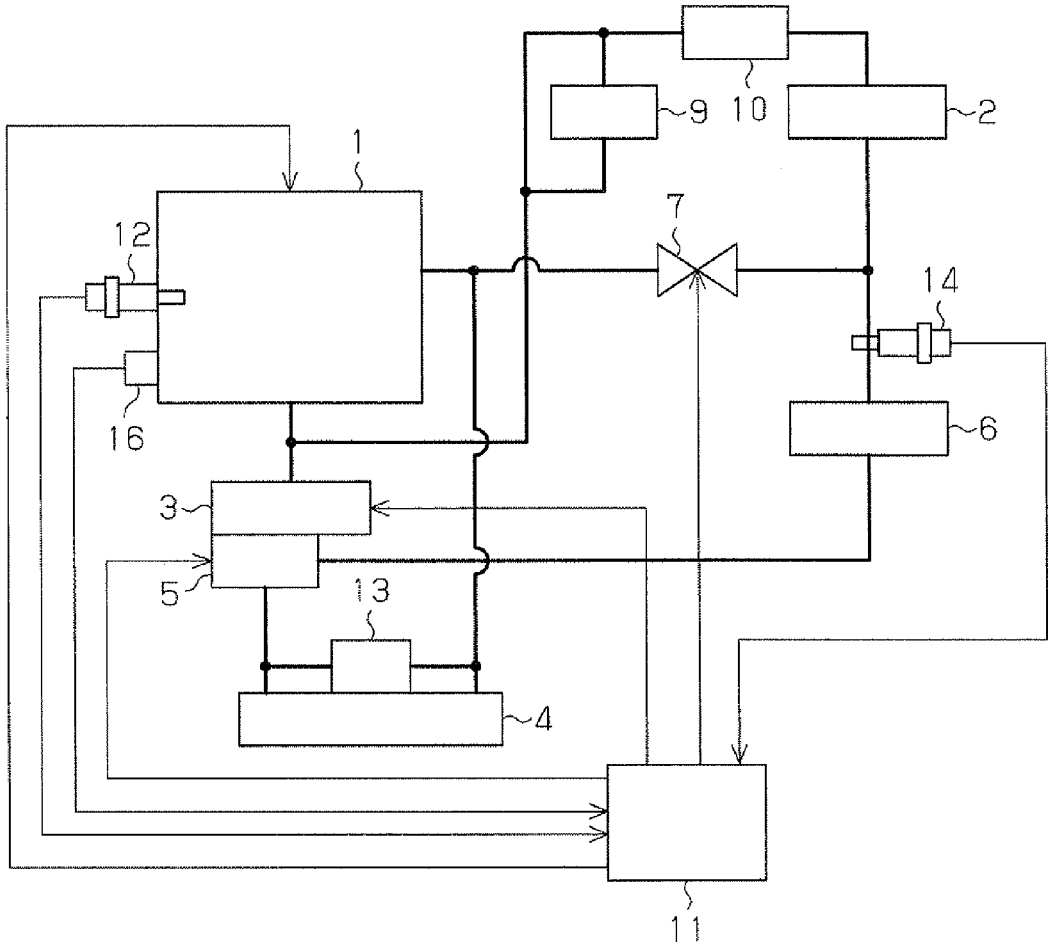
FIG. 1 is a block diagram schematically showing the overall configuration of a cooling device for a vehicle according to one embodiment of the present invention.

FIG. 1 shows the configuration of a cooling water circuit in a cooling device for a vehicle according to the present invention. The cooling device is provided with a first cooling water circuit for circulating cooling water through the inside of an engine 1 and a second cooling water circuit for circulating cooling water not through the inside of the engine 1 but through an exhaust heat recovery device 2. The cooling water in each of those cooling water circuits can be circulated using a common water pump 3. The water pump 3 is of a motor-driven type and can change the flow rate of discharged cooling water based on a command from an outside. Further, the exhaust heat recovery device 2 performs heat exchange between exhaust gas from the engine 1 and cooling water in the second cooling water circuit to heat the cooling water by the heat of the exhaust gas, thereby functioning as a heat exchanger.

The first cooling water circuit is divided into a main path going through the water pump 3, the engine 1, and a radiator 4 and a bypass path bypassing the radiator 4. The radiator 4 mounted along the main path of the first cooling water circuit radiates the heat of cooling water in the first cooling water circuit into the outside air. In the main path, cooling water discharged from the water pump 3 passes through the engine 1, the radiator 4, and a temperature-sensitive valve 5 and then returns to the water pump 3. The temperature-sensitive valve 5 opens if the temperature of cooling water after passing through a heater core 6 described below reaches a prescribed value (for example, 105° C.) or higher, to permit the cooling water to circulate through the radiator 4. On the other hand, if the temperature of the cooling water after passing through the heater core 6 is less than the prescribed value, the temperature-sensitive valve 5 closes, to inhibit the cooling water from circulating through the radiator 4. That is, in the present cooling device for a vehicle, if the temperature of cooling water flowing into the temperature-sensitive valve 5 reaches the prescribed value or higher, the radiator 4 is activated to release heat from cooling water after it passes through the inside of the engine 1. In the vicinity of such a radiator 4, a reservoir tank 13 is mounted that stores excessive cooling water.

Further, in the bypass path of the first cooling water circuit, cooling water discharged from the water pump 3 passes through the engine 1, a thermostat 7, the heater core 6, and the temperature-sensitive valve 5 and returns to the water pump 3. The thermostat 7 located on the downstream side of the engine 1 along the bypass path is an ON/OFF valve that can be selectively opened and closed based on the temperature of cooling water around it and can be forcedly opened from a closed state if the cooling water is low in temperature. The heater core 6 functions as a heat exchanger that warms air that is sent to the passenger compartment by performing heat exchange between the air and the cooling water. The heater core 6 acts also as a heat utilization device that utilizes heat recovered by the exhaust heat recovery device 2 from an exhaust gas. It is to be noted that the temperature-sensitive valve 5 is formed so as to always permit circulation of the cooling water through such a bypass path. Further, the circulation of the cooling water through the bypass path is stopped if the thermostat 7 is closed. Therefore, if the thermostat 7 and the temperature-sensitive valve 5 are both closed, the circulation of the cooling water through the engine 1 is stopped.

On the other hand, the second cooling water circuit is divided, after going through the water pump 3 shown in FIG. 1, into a path going through a throttle body 9 in the engine 1 and a path not going through the throttle body 9. Those paths join together again and then go through an EGR cooler 10 and the exhaust heat recovery device 2, and then join the bypass path on the upstream side of the heater core 6. The EGR cooler 10 mounted along the second cooling water circuit is configured to cool exhaust gas flowing back to the intake system from the exhaust system of the engine 1, that is, recirculation gas.

Next, a description will be given of the specific structure and operation aspect of the thermostat 7 with reference to FIGS. 2(*a*) to 2(*c*).

As shown in FIG. 2(*a*), the thermostat 7 is provided with a valve body 22 that is biased by a spring 21 in its closing direction (leftward direction in the drawing) and a thermoelement 23 that opens the valve body 22 against biasing force exerted by the spring 21. The thermoelement 23 projects and retracts a shaft 24 in response to thermal expansion and contraction of wax sealed in it, to selectively open and close the valve body 22 through projection and retraction of the shaft 24 as well as the biasing force exerted by the spring 21. Through such opening and closing operations, the valve body 22 inhibits and permits the passage of cooling water through the thermostat 7.

Accordingly, if the temperature of cooling water around the thermoelement 23 is low, the wax in the thermoelement 23 contracts thermally to retract the shaft 24, so that the valve body 22 of the thermostat 7 is closed by biasing force exerted by the spring 21. In this situation, passage of the cooling water along the bypass path of the first cooling water circuit is inhibited by the closed valve body 22, so that the passage of the cooling water through the inside of the engine 1 is also inhibited. On the other hand, if the temperature of the cooling water around the thermostat 7 is high, as shown in FIG. 2(*b*), the wax in the thermoelement 23 expands thermally to project the shaft 24, so that the valve body 22 of the thermostat 7 is opened against the biasing force exerted by the spring 21. In this situation, the passage of the cooling water along the bypass of the first cooling water circuit is permitted by the open valve body 22, so that the passage of the cooling water through the inside of the engine 1 is also permitted.

Further, the thermostat 7 is provided with a heat generator 25 for heating the thermoelement 23 in order to forcedly open the valve body 22 in a condition where it is closed due to a low temperature of the cooling water around it. The heat generator 25 heats the thermoelement 23 by generating heat when it is energized electrically. If the thermoelement 23 is heated by the heat generator 25 in such a manner, the valve body 22 can be opened forcedly even if the valve body 22 is in the closed state due to a low temperature of the cooling water around the thermoelement 23. However, if the temperature of the cooling water is low around the thermoelement 23, it takes a long time (for example, 20 to 30 seconds since starting of heating) until the wax in the thermoelement 23 thermally expands when it is heated by the heat generator 25 to project the shaft 24, thereby opening the valve body 22 completely. Accordingly, to cope with a situation in which the valve body 22 in the close state needs to be completely opened quickly, the thermostat 7 is formed as follows.

That is, in the thermostat 7, the valve body 22 in the closed state due to a low temperature of cooling water around it can be opened by an external device independently of operations of the thermoelement 23 that are based on the temperature of the cooling water. Specifically, in the thermostat 7, if the flow rate of cooling water discharged from the water pump 3 exceeds the maximum value of a normal use region because the valve body 22 is subjected to a pressure of the cooling water that is about to circulate through the bypass path of the first cooling water circuit when the water pump 3 is driven, the valve body 22 can be opened on the basis of the pressure of the cooling water. In other words, the biasing force exerted by the spring 21 for biasing the valve body 22 in the closing direction is set to a value greater than the force based on the pressure of cooling water acting on the valve body 22 when the discharge flow rate of the water pump 3 is a value within the normal use region, and a value smaller than that based on the pressure of the cooling water acting on the valve body 22 when the discharge flow rate of the water pump 3 is a value greater than the maximum value of the normal use region. Accordingly, in a situation in which the valve body 22 in the closed state needs to be completely opened quickly, the discharge flow rate of the water pump 3 should be set to a value greater than the maximum value of the normal use region so that the valve body 22 can be completely opened with good response by the force based on a water pressure applied on the valve body 22 as shown in FIG. 2(*c*). It is to be noted that the normal use region of the discharge flow rate of the water pump 3 refers to a range of such a discharge flow rate of the water pump 3 as to keep the valve body 22 in its closed state even if the pressure of cooling water acts on it during normal operation of the engine 1.

Next, a description will be given of an electrical configuration of the cooling device for a vehicle in the present embodiment with reference to FIG. 1.

The cooling device for a vehicle is provided with an engine cooling control unit 11 for controlling the discharge flow rate of the aforesaid water pump 3 and forced opening of the valve body 22 by use of the heat generator 25 in the thermostat 7.

The engine cooling control unit 11 is an electronic control unit provided with a CPU for performing various kinds of arithmetic operations related to control on cooling of the engine 1, a ROM in which control programs and data are stored, a RAM for temporarily storing results of the operations by the CPU and those of detection by sensors, and an I/O in charge of inputting signals from and outputting signals to the outside. It is to be noted that the engine cooling control unit 11 is supplied with detection signals from water temperature sensors 12 and 14 and an air flowmeter 16. The water temperature sensor 12 detects a cooling water temperature thw1 at an outlet of the engine 1 in the first cooling circuit. The water temperature sensor 14 detects the temperature thw2 of cooling water flowing into the heater core 6. The air flowmeter 16 detects an intake air amount for the engine 1.

FIG. 3 shows a state of cooling water circulation in the engine 1 and operating states of the thermostat 7 and the temperature-sensitive valve 5 corresponding to a warm-up state of the engine 1 in the cooling device for a vehicle in the present embodiment. As shown in the diagram, when the engine 1 is cold, the thermostat 7 and the temperature-sensitive valve 5 are closed, so that the cooling water is inhibited from circulating through the inside of the engine 1. On the other hand, if the engine 1 is in a half-warmed-up state, the thermostat 7 is opened to start circulation of the cooling water through the inside of the engine 1. After the engine 1 is warmed up, the temperature-sensitive valve 5 also opens to activate the radiator 4, thereby radiating heat of the cooling water.

It is to be noted that "after the engine 1 is warmed up" refers to a state in which the cooling water temperature thw1 used in place of the temperature of the engine 1 has reached at least a warming-up determination value (for example, 90° C.) that denotes a completely warmed up state of the engine 1. Further, the half-warmed-up state of the engine 1 refers to a state in which the cooling water temperature thw1 is less than the warming-up determination value (90° C.) but not less than a half-warmed-up determination value set to a temperature (for example, 70° C.) lower than the warming-up determination value. Furthermore, "when the engine 1 is cold" refers to a state in which the cooling water temperature thw1 is less than the half-warmed-up determination value (70° C.).

Figure 4:
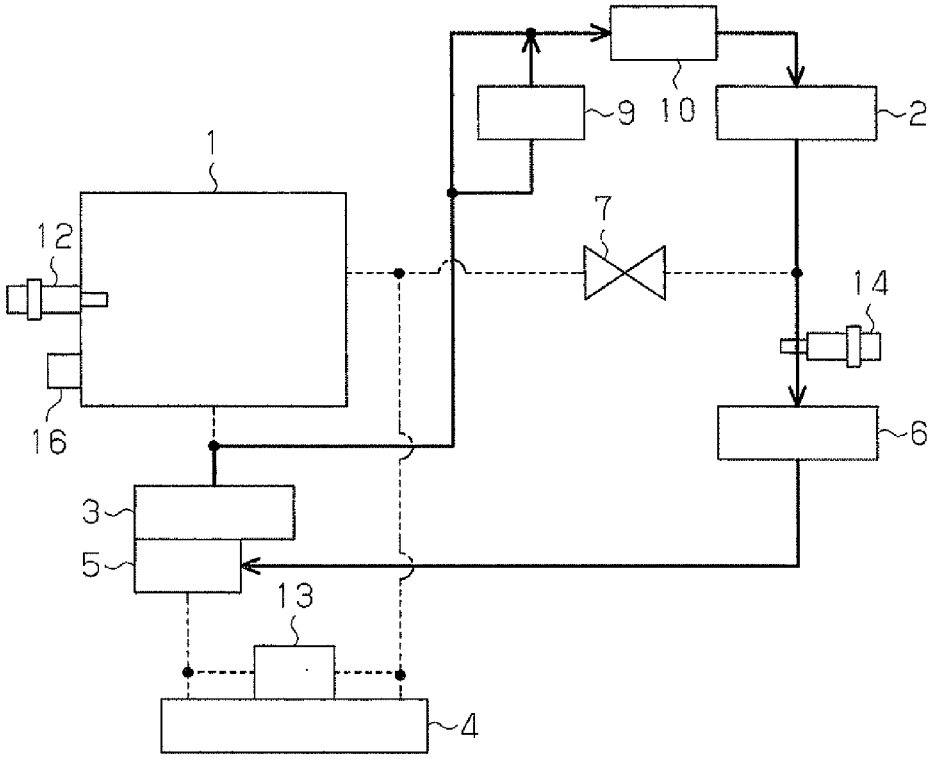
FIG. 4 is a block diagram showing a flow of cooling water in the cooling device for a vehicle in the present embodiment when the engine is in a cold state.

FIG. 4 shows a flow of cooling water when the engine 1 is cold. In this state, the thermostat 7 and the temperature-sensitive valve 5 are both closed, to inhibit the cooling water from circulating through the first cooling water circuit. If the cooling water stagnates in the engine 1 because it is inhibited from circulating in the first cooling water circuit in such a manner, temperature rising of the cooling water in the engine 1 is promoted to accelerate warming up of the engine 1.

Further, in this state, the cooling water is circulated only in the second cooling water circuit as shown in the drawing. That is, in this state, the cooling water circulates from the water pump 3 to the throttle body 9, the EGR cooler 10, the exhaust heat recovery device 2, the heater core 6, and the temperature-sensitive valve 5. Such cooling water in the second cooling water circuit is configured to rise in temperature owing to heat recovered from exhaust air in the EGR cooler 10 and the exhaust heat recovery device 2. If a heater is in the ON-state in the passenger compartment in this situation, air to be sent to the passenger compartment is warmed by the heat recovered from the exhaust air in the EGR cooler 10 and the exhaust heat recovery device 2. In this case, a lot of the recovered heat is used by the heater, so that temperature rising of the cooling water is retarded. In such a case, the temperature of the cooling water inside the engine 1 rises faster than that of the cooling water in the second cooling water circuit. If the thermostat 7 is opened after the engine 1 is warmed up completely (thw1≥90° C.) in this situation to mix the cooling water in the second cooling water circuit and that in the first cooling water circuit, the cooling water temperature thw1 rises and falls across the aforesaid warming-up determination value, so that a trouble may occur in control on switching control contents based on whether the cooling water temperature thw1 is higher than or equal to the warming-up determination value.

Accordingly, in the cooling device in the present embodiment, if the cooling water temperature thw1 is less than the warming-up determination value (70° C.), that is, less than the half-warmed-up determination value, or in other words, if the engine 1 is cold, the thermostat 7 is closed. If the cooling water temperature thw1 reaches at least the half-warmed-up determination value, the thermostat 7 is opened to mix the cooling water in both cooling water circuits. More specifically, properties such as the coefficient of thermal expansion of the wax charged in the thermoelement 23 are set so that heating of the thermoelement 23 by the heat generator 25 in the thermostat 7 may be stopped if the cooling water temperature thw1 is less than the aforesaid half-warmed-up determination value and that the valve body 22 may open if the temperature of the cooling water around the thermoelement 23 reaches the half-warmed-up determination value. Further, to reliably open the valve body 22 of the thermostat 7 if the cooling water temperature thw1 reaches at least the half-warmed-up determination value, the thermoelement 23 is heated by the heat generator 25 if the cooling water temperature thw1 rises to the half-warmed-up determination value.

Figure 5:
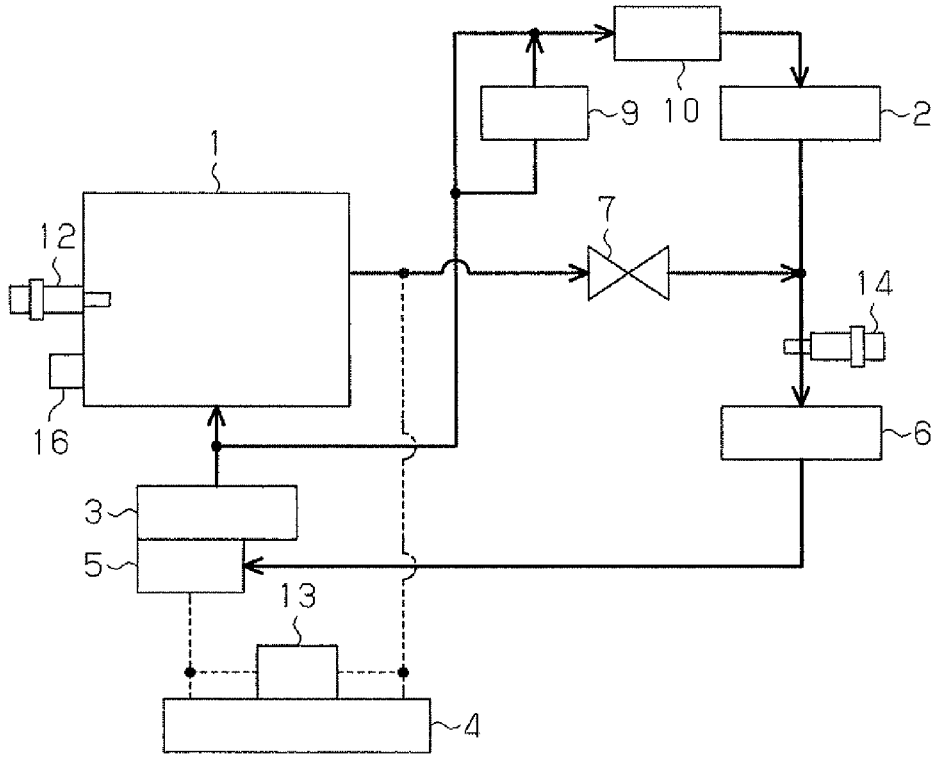
FIG. 5 is a block diagram showing the flow of cooling water in the cooling device for a vehicle in the present embodiment when the engine is half warmed-up state.

With this, after the engine 1 is started from its cold state, the thermostat 7 in the closed state is opened if the cooling water temperature thw1 rises at least to the half-warmed-up determination value. FIG. 5 shows a flow of the cooling water in this situation. In this situation, the thermostat 7 is opened to start circulation of the cooling water through the inside of the engine 1. Then, the cooling water after passing through the inside of the engine 1 passes through the open thermostat 7 and is mixed with the cooling water flowing through the second cooling water circuit on the upstream side of the heater core 6.

Figure 6:
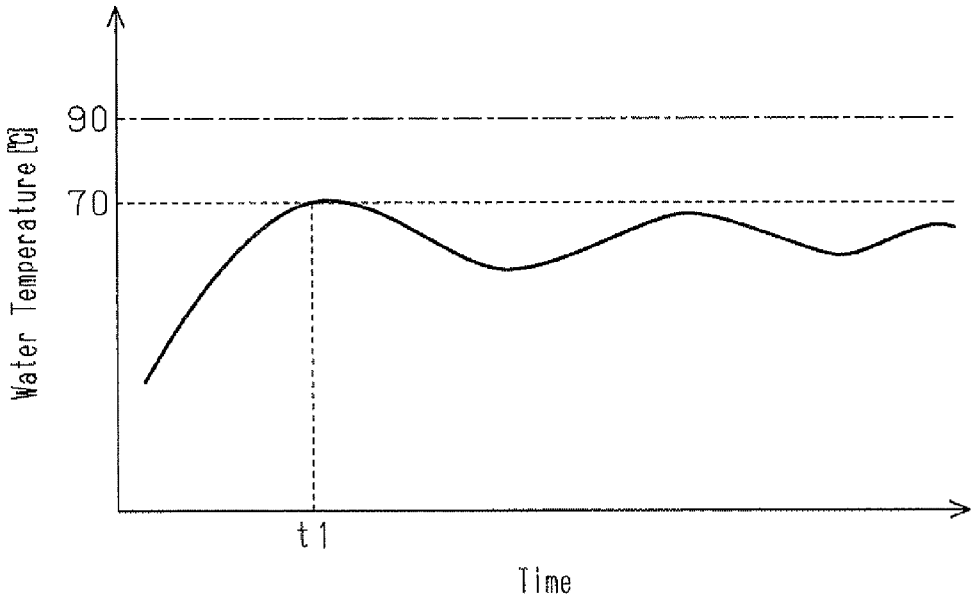
FIG. 6 is a graph showing a transition of the temperature of the cooling water inside the engine before and after the valve is opened in the cooling device for a vehicle in the present embodiment.

FIG. 6 shows a transition of the temperature of the cooling water in the inside of the engine 1 before and after the aforesaid thermostat 7 is opened. In the cooling device for a vehicle in the present embodiment, as described above, if the temperature of the cooling water inside the engine 1 reaches at least the half-warmed-up determination value set to a temperature (70° C.) lower than the warming-up determination value for the engine 1 (90° C.), the cooling water in the first cooling water circuit is mixed with that in the second cooling water circuit. Therefore, even if the temperature of the cooling water in the second cooling water circuit is low so that the temperature of the cooling water inside the engine 1 may rise and fall as the mixing, it would rise and fall in a temperature range sufficiently lower than the warming-up determination value (90° C.) as shown in the drawing. Therefore, even if the thermostat 7 is opened to mix the cooling water in the second cooling water circuit and that in the first cooling water circuit, the cooling water temperature thw1 rises and falls across the aforesaid warming-up determination value, no trouble occurs in control on switching the control contents based on whether the cooling water temperature thw1 is higher than or equal to the warming-up determination value.

Immediately after the engine 1 is started up from its cold state and the thermostat 7 is closed so that the engine 1 is about to be warmed up, if a great amount of heat is generated in the combustion chamber owing to high-load operation of the engine 1, such a situation occurs in which the temperature of only the cooling water in the cylinder head of the engine 1 rises and that of the cooling water around the thermostat 7 does not rise. In such a situation, the cooling water stagnant in the cylinder head of the engine 1 receives the heat from the combustion chamber, so that the cooling water rises excessively in temperature and will possibly boil.

To deal with such a situation, if the temperature of the cooling water in the cylinder head of the engine 1 rises to such a value that it will possibly boil in condition where the valve body 22 of the thermostat 7 is closed, such an approach is possible to heat the thermoelement 23 by using the heat generator 25 in the thermostat 7 so that the valve body 22 may be opened forcedly even if the temperature of the cooling water around the thermostat 7 is low. By opening the valve body 22 in such a manner, water is permitted to enter the engine 1 so that eventually the cooling water stagnant in the cylinder head may be suppressed from boiling.

However, in a case where the temperature of the cooling water around the thermoelement 23 is low, even if the thermoelement 23 is heated by the heat generator 25, it takes a long time such as 20 to 30 seconds, for example, until the valve body 22 is correspondingly opened completely since the start of heating. Therefore, even if the thermoelement 23 is heated by the heat generator 25, the cooling water stagnant in the cylinder head will possibly boil before the valve body 22 is actually opened to permit water to actually enter the engine 1.

Figure 7:
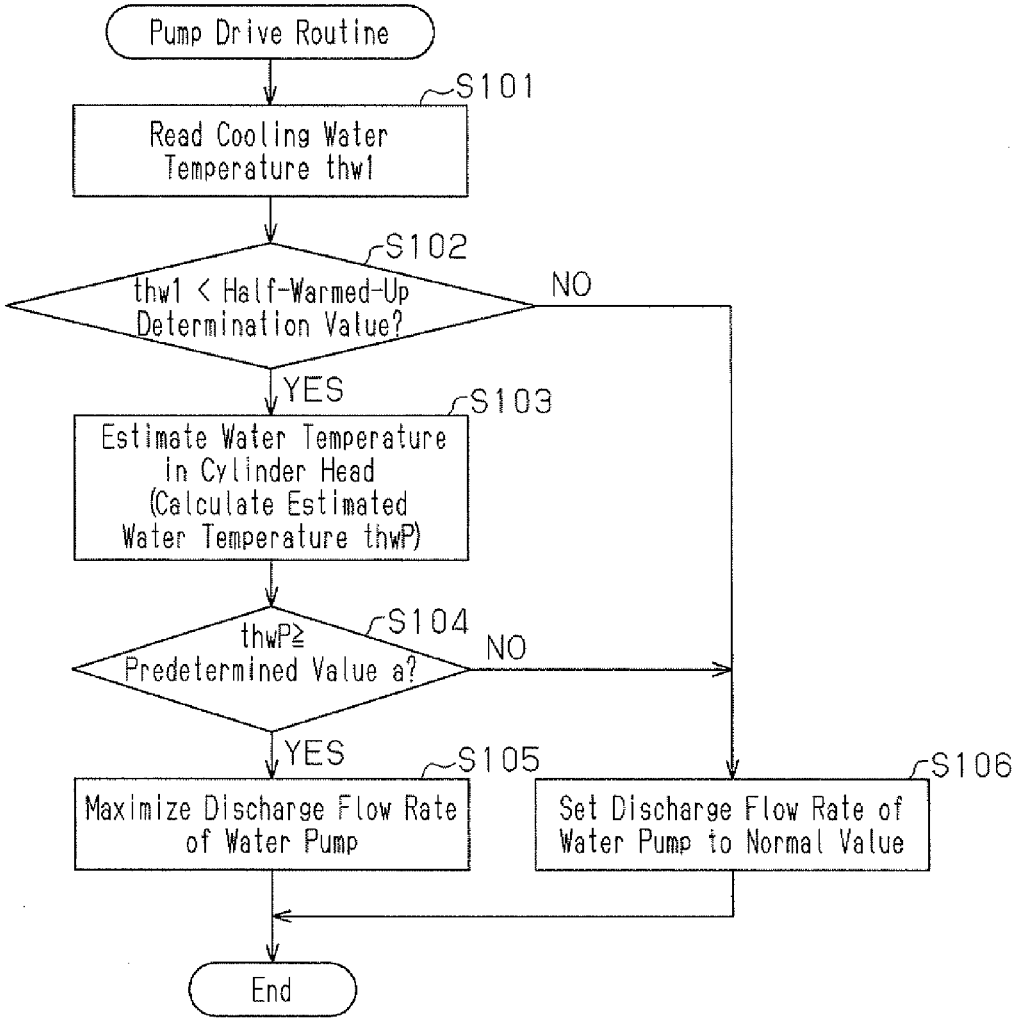
FIG. 7 is a flowchart showing a procedure for driving a water pump.

Next, a description will be given of a countermeasure by the present embodiment against the aforesaid problem in that the cooling water stagnant in the cylinder head of the engine 1 may boil due to the closed state of the thermostat 7 in such a case where the engine 1 undergoes high-load operations immediately after the engine 1 is started up from its cold state, with reference to a flowchart in FIG. 7 showing a pump drive routine. The pump drive routine is configured to drive the water pump 3 and executed periodically in an interrupting manner at predetermined time intervals by way of the engine cooling control unit 11.

In this routine, first, the engine cooling control unit 11 reads the cooling water temperature thw1 (step S101) and determines whether the cooling water temperature thw1 is less than the half-warmed-up determination value (step S102). If the determination turns out affirmative, it means that the engine 1 is in the cold state and the thermostat 7 is in the closed state. Then, if the determination in step S102 turns out affirmative, the engine cooling control unit 11 estimates the temperature of the cooling water in the cylinder head of the engine 1 based on an accumulated amount value of air taken into the engine 1 since start-up of the engine 1 and the cooling water temperature thw1, which is a value of the temperature of the cooling water actually measured by the water temperature sensor 14 (step S103).

Figure 8:
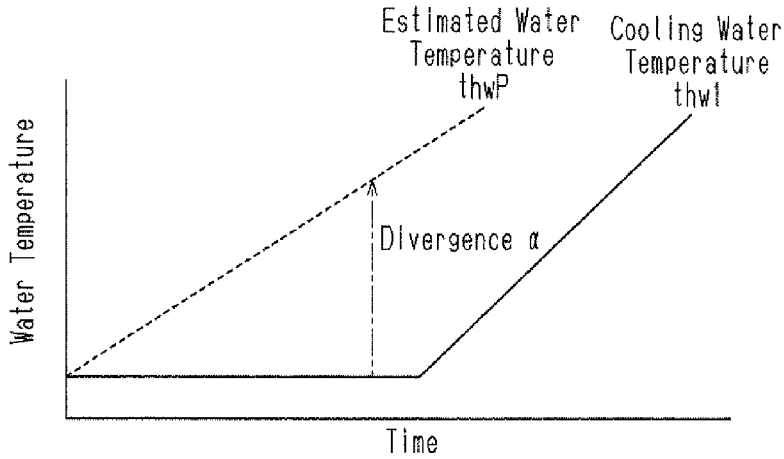
FIG. 8 is a graph showing a transition of the temperature of the cooling water measured by a water temperature sensor and an estimated temperature of water in a cylinder head.

The accumulated amount value of the intake air is obtained by accumulating the amount of air taken into the engine 1 calculated at each predetermined timing based on the detection signal from the air flowmeter 16 for each calculation. The accumulated amount value of the intake air obtained in such a manner corresponds to a total value of fuel consumed in the engine 1 since start-up of the engine 1, in other words, the total value of heat amount generated in the engine 1. Then, in processing in step S103, an amount of divergence $\alpha$ from the cooling water temperature thw1 at a temperature of the cooling water in the cylinder head is calculated on the basis of the accumulated amount value of the intake air. By adding the amount of divergence $\alpha$ to the cooling water temperature thw1, an estimated water temperature thwP is calculated. It is to be noted that those cooling water temperature thw1 and estimated water temperature thwP transit as shown in FIG. 8, for example, as time passes since the start-up of the engine 1 from its cold state.

If the estimated water temperature thwP is calculated in the processing in step S103 shown in FIG. 7, the engine cooling control unit 11 determines whether the estimated water temperature is higher than or equal to a predetermined value A (step S104). If the determination turns out affirmative, it is determined that the cooling water in the cylinder head will possibly boil, whereas if the determination turns out negative, it is determined that the cooling water in the cylinder head will not boil. As the predetermined value A, such a value is experimentally obtained so as to enable reliably making such a determination. Then, if the temperature of the cooling water in the cylinder head rises rapidly owing to high-load operation of the engine 1 in condition where the thermostat 7 is in the closed state, the determination in step S104 turns out affirmative. In this case, the engine cooling control unit 11 drives the water pump 3 so that the discharge flow rate of the water pump 3 may become a value greater than the maximum value of the normal use region, for example, may be maximized (step S105). Then, if the discharge flow rate of the water pump 3 is maximized, the force applied in the opening direction by water pressure acting on the valve body 22 of the thermostat 7 becomes greater than biasing force exerted by the spring 21 acting on the valve body 22 in the closing direction. This causes the valve body 22 to quickly open completely with good response. By completely opening the valve body 22 with good response in such a manner, the cooling water stagnant in the cylinder head is prevented from boiling. That is, the cooling water stagnant in the cylinder head is prevented from boiling because water passing into the cylinder head is retarded by opening of the valve body 22 in such a case where it takes a long time until the valve body 22 is opened completely.

If it is determined in the processing in step S102 that the cooling water temperature thw1 is higher than or equal to the half-warmed-up determination value or that the estimated water temperature thwP is less than the predetermined value A in step S104, the discharge flow rate of the water pump 3 is set to a normal value (step S106). That is, the water pump 3 is driven in such a manner that the discharge flow rate of the water pump 3 is changed appropriately in the normal use region depending on circumstances.

The present embodiment described in detail hereinabove will provide the following advantages.

(1) Immediately after the engine 1 is started up from its cold state, the temperature of cooling water around the thermoelement 23 of the thermostat 7 becomes less than the half-warmed-up value. Accordingly, the valve body 22 of the thermostat 7 is closed to inhibit the cooling water in the engine 1 from passing. In this situation, if the engine 1 undergoes high-load operation, the cooling water stagnant in the cylinder head receives heat from the combustion chamber, so that the temperature of the cooling water rises. However, the temperature of the cooling water around the thermoelement 23 rises little because the valve body 22 of the thermostat 7 is in the closed state. In such a situation, even if the thermoelement 23 is heated by the heat generator 25 in order to open the valve body 22 of the thermostat 7, it takes a long time, for example, 20 to 30 seconds until the valve body 22 is actually opened completely since start of the heating. Therefore, the cooling water stagnant in the cylinder head will possibly boil before the valve body 22 of the thermostat 7 is opened completely.

However, if the temperature (estimated water temperature thwP) of the cooling water in the cylinder head that is estimated on the basis of the engine operation condition such as the intake-air amount and the cooling water temperature thw1 is higher than or equal to such a value (predetermined value A) that it will possibly boil after the engine 1 is started up from the cold state, the discharge flow rate of the water pump 3 is set to a value greater than the maximum constant value in the normal use region. If the discharge flow rate of the water pump 3 is set greater than the maximum value in the normal use region, the force applied in the opening direction by the water pressure acting on the valve body 22 of the thermostat 7 becomes greater than the biasing force exerted by the spring 21 acting on the valve body 22 in its closing direction, so that the valve body 22 is quickly opened with good response. Therefore, by setting the discharge flow rate of the water pump 3 greater than the maximum value in the normal use region in the aforesaid situation, the valve body 22 is quickly opened with good response to pass the water into the engine 1. It enables preventing the cooling water stagnant in the cylinder head from boiling before the valve body 22 is opened completely.

(2) The estimated water temperature thwP is estimated based on an accumulated amount value of air taken into the engine 1 since start-up of the engine and an actual measurement value (cooling water temperature thw1) of the temperature of the cooling water at the outlet of the engine 1 in the first cooling water circuit. In more detail, the accumulated value is calculated by accumulating the amount of the intake air calculated at each predetermined timing each time the calculation is performed. By adding an amount of divergence $\alpha$ calculated on the basis of the accumulated value and the cooling water temperature thw1 to the cooling water temperature thw1, the estimated water temperature thwP is calculated. It enables correlating the calculated estimated water temperature thwP accurately with the actual temperature of the cooling water in the cylinder head.

The aforesaid embodiment may be modified as follows, for example.

When re-setting the discharge flow rate of the water pump 3 to a value greater than the maximum value in the normal use region, the value does not need to be maximized.

Although the water pump 3 has been described as an example of an external device for forcedly opening the valve body 22 of the thermostat 7, any other external device such as a motor may be used to open the valve body 22.

The invention claimed is:

1. A thermostat located on the downstream side of an engine in a cooling water circuit in which cooling water is circulated through the inside of the engine by driving a pump, the thermostat comprising:

a valve body for inhibiting or permitting passage of the cooling water flowing through the thermostat;

a thermoelement for driving the valve body based on a temperature of the cooling water, wherein if the temperature of the cooling water is lower than a determination value, the valve body is closed to inhibit passage of the cooling water through the inside of the engine, and if the temperature of the cooling water is higher than or equal to the determination value, wherein the thermoelement, which receives heat transferred from the cooling water, opens the valve body to permit passage of the cooling water through the inside of the engine; and a heat generator for heating the thermoelement in order to open the valve body forcedly if the temperature of the cooling water in the cooling water circuit is lower than the determination value, wherein the temperature of the cooling water in the cylinder head of the engine is estimated by a control unit based on an accumulated amount value of air taken into the engine since its start-up and a value of the temperature of the cooling water actually measured by the water temperature sensor at the outlet of the engine in the cooling water circuit, and wherein, when the estimated cooling water temperature is higher than or equal to a predetermined value, the valve body is opened by an external device independently of operation of the thermostat based on the temperature of the cooling water in the cooling water circuit.

2. A thermostat located on the downstream side of an engine in a cooling water circuit in which cooling water is circulated through the inside of the engine by driving a pump, the thermostat comprising:

a valve body for inhibiting or permitting passage of the cooling water flowing through the thermostat;

a thermoelement for driving the valve body based on a temperature of the cooling water, wherein if the temperature of the cooling water is lower than a determination value, the valve body is closed to inhibit passage of the cooling water through the inside of the engine, and if the temperature of the cooling water is higher than or equal to the determination value, the thermoelement, which receives heat transferred from the cooling water, opens the valve body to permit passage of the cooling water through the inside of the engine; and a heat generator for heating the thermoelement in order to open the valve body forcedly if the temperature of the cooling water in the cooling water circuit is lower than the determination value, wherein the temperature of the cooling water in the cylinder head of the engine is estimated by a control unit based on an accumulated amount value of air taken into the engine since its start-up and a value of the temperature of the cooling water actually measured by the water temperature sensor at the outlet of the engine in the cooling water circuit, and wherein, when the estimated cooling water temperature is higher than or equal to a predetermined value, the valve body receives pressure from the cooling water circulated through the cooling water circuit by driving the pump and is opened on the basis of the pressure of the cooling water if the discharge flow rate of the cooling water from the pump is greater than a maximum value in a normal use region.

3. The thermostat according to claim 2, wherein the valve body is biased in a closing direction by a spring, the thermoelement is adapted to open the valve body against biasing force exerted by the spring, wherein the biasing force is a value that is greater than force based on the pressure of the cooling water acting on the valve body when the discharge flow rate of the pump is a value in the normal use region, and smaller than the force based on the pressure of the cooling water acting on the valve body when the discharge flow rate of the pump is a value greater than the maximum value in the normal use region.

4. The thermostat according to claim 2, wherein the valve body opens when the discharge flow rate of the pump is the maximum.

5. The thermostat according to claim 2, wherein the thermostat is part of a cooling device for a vehicle, and the cooling device comprising:

a cooling water circuit through which cooling water is circulated through the inside of an engine by driving a pump;

a water temperature sensor for detecting a temperature of the cooling water at an outlet of the engine along the cooling water circuit; and a control unit for controlling driving of the pump and the thermostat, wherein the thermostat is adapted to close the valve body when the temperature of the cooling water around the thermoelement is less than the determination value, the control unit is adapted to open the valve body in a closed state by heating the thermoelement with the heat generator of the thermostat when the temperature of the cooling water detected by the water temperature sensor reaches at least the determination value, and in a case where the temperature of the cooling water detected by the water temperature sensor after start-up of the engine from its cold state is less than the determination value, if the temperature of the cooling water in the cylinder head of the engine estimated on the basis of operation conditions of the engine is higher than or equal to such a value that the cooling water will possibly boil, the control unit sets the discharge flow rate of the pump to a value greater than the maximum value in the normal use region.

* * * * *